US007368680B2

(12) United States Patent
Sakurai et al.

(10) Patent No.: US 7,368,680 B2
(45) Date of Patent: May 6, 2008

(54) METHOD OF PRODUCING A PLATE STACK PREFORM FOR HYDROSTATIC FORMING

(75) Inventors: Hiroshi Sakurai, Kanagawa (JP); Kenji Kanamori, Yokohama (JP); Shigeyuki Nakagawa, Kanagawa (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 416 days.

(21) Appl. No.: 11/224,299

(22) Filed: Sep. 13, 2005

(65) Prior Publication Data

US 2006/0059967 A1 Mar. 23, 2006

(30) Foreign Application Priority Data

Sep. 13, 2004 (JP) ..... 2004-264891

(51) Int. Cl.
*B23K 11/06* (2006.01)

(52) U.S. Cl. ..... 219/117.1; 219/78.12

(58) Field of Classification Search ..... 219/117.1, 219/78.11, 78.12, 82, 83, 92
See application file for complete search history.

(56) References Cited

U.S. PATENT DOCUMENTS 2,445,801 A * 7/1948 Partiot ..... 219/78.12
2,975,263 A * 3/1961 Green et al. ..... 219/78.12

FOREIGN PATENT DOCUMENTS

JP 2003-320960 A 11/2003
JP 2004-160485 A 6/2004

* cited by examiner

*Primary Examiner*—Clifford C. Shaw
(74) *Attorney, Agent, or Firm*—Foley & Lardner LLP

(57) ABSTRACT

A method of producing a plate stack preform, including preparing a reinforcement stack having first and second reinforcing plates, overlapping first and second plates respectively larger in size than the first and second reinforcing plates on the first and second reinforcing plates, respectively, inserting a weld-preventing conductive plate between side peripheries of the overlapped first and second reinforcing plates, after the inserting operation, simultaneously conducting joining the first plate with the side periphery of the first reinforcing plate and joining the second plate with the side periphery of the second reinforcing plate by lap resistance welding, and then joining side peripheries of the first and second plates together by continuous welding.

14 Claims, 4 Drawing Sheets

METHOD OF PRODUCING A PLATE STACK PREFORM FOR HYDROSTATIC FORMING

BACKGROUND OF THE INVENTION

The present invention relates to a method of producing a preform for hydrostatic forming, and specifically, relates to a method of producing a plate stack preform useable for hydrostatically forming a product including a frame and a reinforcement which is disposed within the frame and has an X-shaped or cross shaped section.

Japanese Patent Application First Publication No. 2003-320960 describes a method of producing a frame member, for example, a side sill, a center pillar and a side roof rail, by a so-called hydrostatic forming process that is also referred to as a hydroform process or a hydrostatic bulge forming process. In the method of this related art, in order to provide a frame member with a reinforcement having an X-shaped or cross-shaped section from the viewpoint of rigidity, a four-plate stack preform is used. The four-plate stack preform includes two outer plates and a reinforcement stack between the two outer plates which is formed by two overlapping reinforcing plates joined to be in the form of a flattened X-shape or cross shape in section. The two reinforcing plates are welded to each other at a point corresponding to an intersection of the X-shape or cross shape of the reinforcement and welded to the two outer plates along opposed peripheral edges thereof. The two outer plates are welded to each other along opposed peripheral edges thereof. Upon hydrostatic forming, the four-plate stack preform is set in a die and supplied with a hydraulic pressure to thereby bulge the outer plates until the outer plates come into intimate contact with an inside surface of the die and the flattened X-shape or cross shape of the reinforcement stack is developed into the X-shape or cross shape of the reinforcement. Thus, the frame member with the reinforcement having the X-shaped or cross-shaped section is produced.

SUMMARY OF THE INVENTION

In the method of the above-described related art, it is required to provide five continuous welding joints between the reinforcing plates and between the reinforcing plates and the outer plates by laser welding or arc welding, in addition to two continuous welding joints between the outer plates. This leads to undesirable increase in welding area and welding time, and thereby will cause significant reduction in productivity and increase in production cost.

It is an object of the present invention to provide a method of producing a plate stack preform for hydrostatic forming, with increasing productivity.

In one aspect of the present invention, there is provided a method of producing a plate stack preform useable upon hydrostatically forming a product including a frame and a reinforcement which is disposed within the frame and has an X-shape or cross shape in section, the plate stack preform including a flat tubular body and a reinforcement stack within the tubular body, the method comprising:

preparing the reinforcement stack that has a flattened X-shape or cross shape in section and includes a first reinforcing plate and a second reinforcing plate overlapped with each other;

overlapping a first plate larger in size than the first reinforcing plate of the reinforcement stack on the first reinforcing plate thereof and a second plate larger in size than the second reinforcing plate of the reinforcement stack on the second reinforcing plate thereof;

inserting a weld-preventing conductive plate between side peripheries of the overlapped first and second reinforcing plates of the reinforcement stack, the weld-preventing conductive plate preventing the side peripheries of the overlapped first and second reinforcing plates from being welded to each other;

after the inserting operation, simultaneously conducting joining the first plate with the side periphery of the first reinforcing plate and joining the second plate with the side periphery of the second reinforcing plate by lap resistance welding; and after the simultaneously conducting joining operation, joining side peripheries of the first plate and side peripheries of the second plate by continuous welding, to form the flat tubular body within which the reinforcement stack is disposed.

DETAILED DESCRIPTION OF THE INVENTION

Figure 1A:
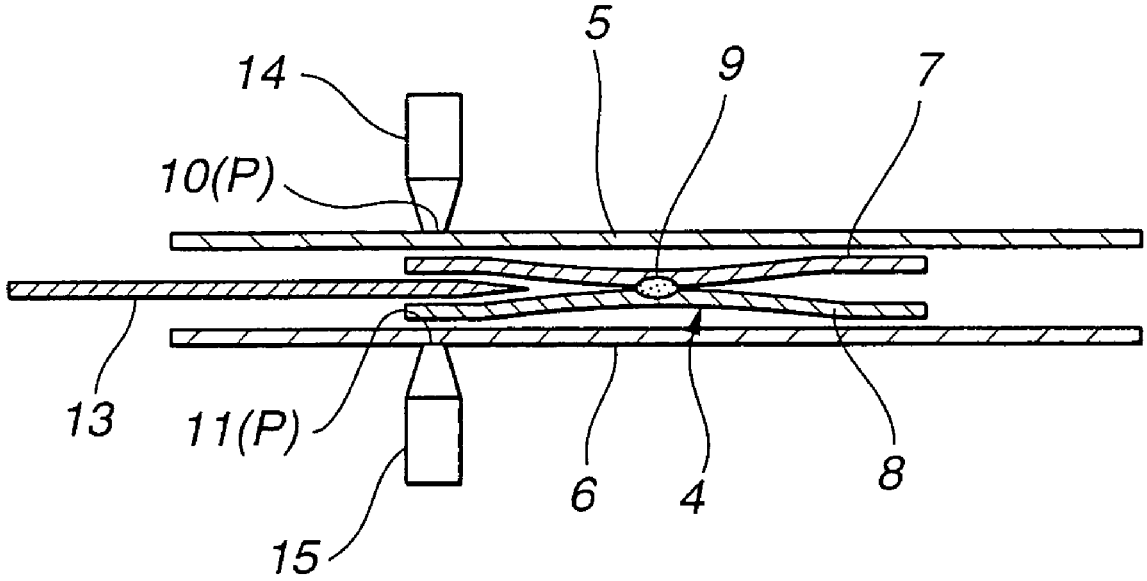
FIG. 1A is an explanatory diagram illustrating a method of a first embodiment according to the present invention, showing a sectional view of a plate stack being subjected to welding.
Figure 1B:
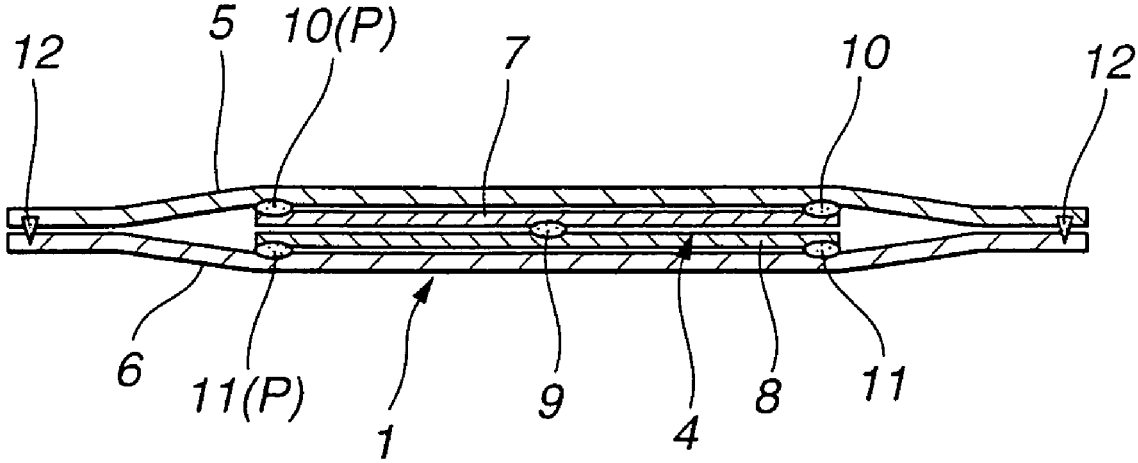
FIG. 1B is a sectional view of a preform produced by the method of the first embodiment as shown in FIG. 1A.

In the followings, embodiments of the present invention will be described with reference to the accompanying drawings. For ease of understanding, various directional terms, such as upper, lower, upward, downward and the like, are used in the following description. However, the terms denote the directions merely in the drawings. Referring to FIGS. 1A-4, a first embodiment of the present invention is explained. FIG. 1A shows a method of the first embodiment. FIG. 1B shows a section of preform 1 produced by the method as shown in FIG. 1A, taken along a lateral direction perpendicular to a longitudinal direction of preform 1. Preform 1 is useable upon producing a hollow frame member by hydrostatic forming. In this embodiment, preform 1 is used upon producing vehicular frame member 2 as shown in FIG. 5. FIG. 5 illustrates a section of vehicular frame member 2 that is elongated and closed in section, taken along a lateral direction perpendicular to a longitudinal direction of frame member 2. As illustrated in FIG. 5, frame member 2 includes a tubular body and reinforcement 3 within the tubular body, which has a so-called X-shape or cross shape in section.

As illustrated in FIG. 1B, preform 1 is in the form of a plate stack constituted of four overlapped plates. Specifically, plate-stack preform 1 includes a flat tubular or bag-shaped body and reinforcement stack 4 enclosed in the tubular body. The tubular body includes upper and lower plates 5 and 6 each being formed into a flat elongated plate. Reinforcement stack 4 includes upper and lower reinforcing plates 7 and 8 having a flat elongated plate shape. Upper and lower plates 5 and 6 are larger in size than upper and lower reinforcing plates 7 and 8. Reinforcement stack 4 has a flattened X-shape or cross shape that is developed into the X-shape or cross shape of reinforcement 3 shown in FIG. 5 during a hydrostatic forming process. Reinforcement stack 4 has weld junction 9 corresponding to an intersection of the X-shape or cross shape of reinforcement 3. Upper and lower reinforcing plates 7 and 8 are connected with each other at weld junction 9. Weld junction 9 may be formed by spot welding or continuous welding including laser welding and seam welding. Upper reinforcing plate 7 has opposite side peripheries which are opposed to each other in a lateral direction perpendicular to the longitudinal direction and fixed to upper plate 5 of the tubular body at weld junction 10. Similarly, lower reinforcing plate 8 has opposite side peripheries which are opposed to each other in a lateral direction perpendicular to the longitudinal direction and fixed to lower plate 6 of the tubular body at weld junction 11. Weld junctions 10 and 11 are formed by spot welding. Each of upper and lower plates 5 and 6 has opposite side peripheries opposed to each other in a lateral direction perpendicular to the longitudinal direction. The opposite side peripheries of upper plate 5 are connected with the opposite side peripheries of lower plate 6 at weld junctions 12 to thereby form the flat tubular body. Weld junctions 12 may be formed by continuous welding such as laser welding. The flat tubular body has a closed area in section in which reinforcement stack 4 is disposed.

Referring to FIG. 1A, the first embodiment of the method of producing preform 1 will be explained hereinafter. First, reinforcement stack 4 is prepared in the following manner. Upper and lower reinforcing plates 7 and 8 are overlapped in substantially alignment with each other in a vertical direction, and then welded to each other at a point corresponding to the intersection of the X-shape or cross shape of reinforcement 3. Weld junction 9 connecting upper and lower reinforcing plates 7 and 8 is thus formed at the point as shown in FIG. 1A. The welding may be spot welding or continuous welding including laser welding and seam welding. Thus, reinforcement stack 4 is provided.

Next, upper and lower plate 5 and 6 are overlapped on reinforcement stack 4 so as to be placed in a suitable position relative to reinforcement stack 4 and placed in substantially alignment with each other in the vertical direction. A stack of the four plates 5, 6, 7 and 8 is thus formed. Subsequently, weld-preventing conductive plate 13 is inserted between the vertically opposed side peripheries of upper and lower reinforcing plates 7 and 8 which are located on the left side thereof as shown in FIG. 1A. Similarly, weld-preventing conductive plate 13 is inserted between the vertically opposed side peripheries of upper and lower reinforcing plates 7 and 8 on the right side thereof. The four-plate stack with weld-preventing conductive plates 13 is then subjected to lap resistance welding so as to simultaneously conduct joining upper plate 5 and upper reinforcing plate 7 and joining lower plate 6 and lower reinforcing plate 8. In this embodiment, spot welding is used.

Figure 2:
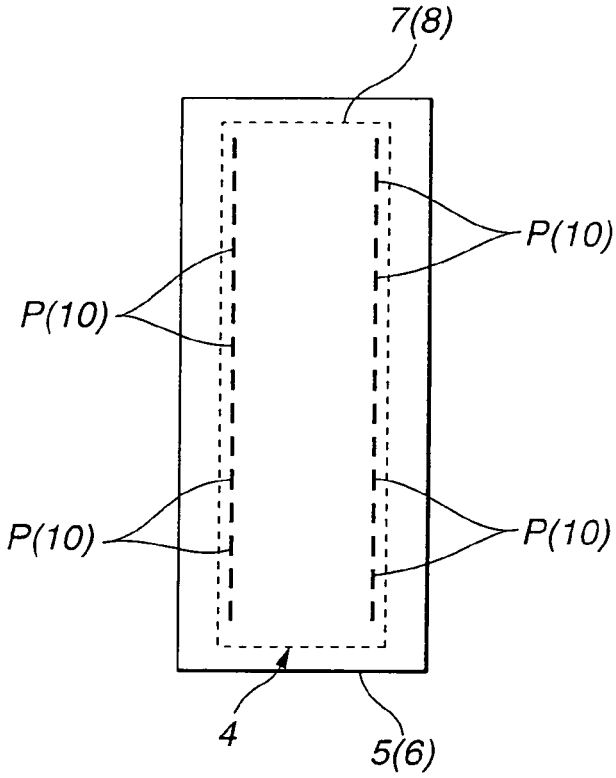
FIG. 2 is an explanatory diagram illustrating positions of weld junctions on the plate stack, showing a top plan view of the plate stack as shown in FIG. 1A.

Specifically, as shown in FIG. 1A, the four-plate stack holding weld-preventing conductive plate 13 between upper and lower reinforcing plates 7 and 8 is sandwiched and pressed between upper electrode tip 14 and lower electrode tip 15. At this time, upper and lower electrode tips 14 and 15 are placed in the position on upper and lower plates 5 and 6 in which electrode tips 14 and 15 are substantially in vertical alignment with the opposed side peripheries of upper and lower reinforcing plates 7 and 8. In this state, an electric current is applied to electrode tips 14 and 15 so that upper plate 5 and the side periphery of upper reinforcing plate 7 are joined together at weld junction 10, and at the same time, lower plate 6 and the side periphery of lower reinforcing plate 8 are joined together at weld junction 11. FIG. 1A only shows a pair of electrode tips 14 and 15 placed in the position corresponding to the vertically opposed side peripheries of reinforcing plates 7 and 8 on the left side, but another pair of electrode tips are placed in the position corresponding to the vertically opposed side peripheries of reinforcing plates 7 and 8 on the right side, and spot welding is conducted using the another pair of electrode tips in the same manner as described above. FIG. 2 shows weld points P, namely, weld junctions 10 formed by spot welding along the longitudinal direction of upper and lower plates 5 and 6 and upper and lower reinforcing plates 7 and 8 of reinforcement stack 4.

Weld-preventing conductive plate 13 is made of a suitable material having an excellent electric conductivity, and may be made of, for example, copper, copper alloys and the like. Further, electrode tips 14 and 15 are made of substantially the same material as that of weld-preventing conductive plate 13. Weld-preventing conductive plate 13 can prevent upper and lower reinforcing plates 7 and 8 from being welded to each other upon applying the electric current to electrode tips 14 and 15.

Preferably, weld-preventing conductive plate 13 has a tapered side periphery formed into a knife edge-shape as shown in FIG. 1A, in view of efficiency of the insertion operation between the opposed side peripheries of upper and lower reinforcing plates 7 and 8 of reinforcement stack 4. By disposing reinforcement stack 4 with weld-preventing conductive plate 13 between upper and lower plates 5 and 6, the positioning of reinforcement stack 4 relative to upper and lower plates 5 and 6 is facilitated.

Figure 3:
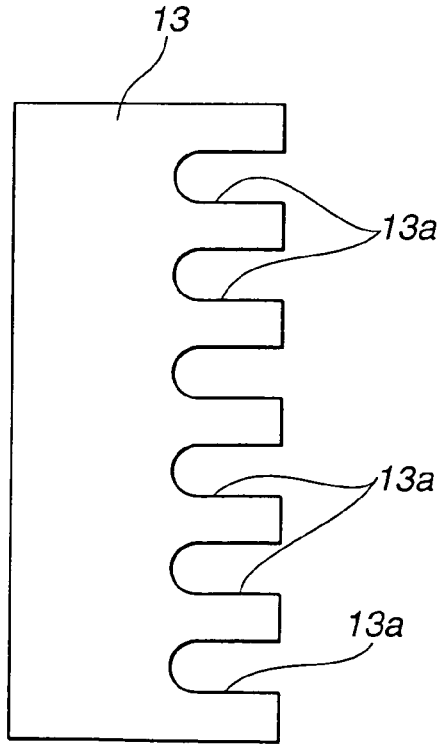
FIG. 3 is a plan view of a weld preventing conductive plate used in first embodiment of the present invention.

Further, as shown in FIG. 3, weld-preventing conductive plate 13 may be formed into a generally comb shape. Weld-preventing conductive plate 13 includes an elongated rectangular body formed with a plurality of cutouts 13*a* at a side periphery thereof. Cutouts 13*a* laterally extend from a side edge and are spaced from one another along the longitudinal direction of the rectangular body. A plurality of projections are defined between cutouts 13*a* and correspond to weld points P as shown in FIG. 2, namely, positions of weld junctions 10 and 11. Cutouts 13*a* of weld-preventing conductive plate 13 can prevent a next weld point P from being adversely affected by a temperature rise caused at the previous weld point P.

Each of electrode tips 14 and 15 has a contact surface coming into contact with upper and lower plates 5 and 6. The contact surface is formed into either one of a rectangular slot shape as shown in FIG. 4 and an elliptic shape, which is elongated in a weld direction.

When the operation of welding reinforcement stack 4 to upper and lower plates 5 and 6 is completed, weld-preventing conductive plate 13 is removed from between upper and lower reinforcing plates 7 and 8 of reinforcement stack 4. Subsequently, the opposite side peripheries of upper plate 5 are joined with the opposite side peripheries of lower plate 6 by continuous welding, for example, laser welding, seam welding and the like. Weld junctions 12 connecting upper and lower plates 5 and 6 are formed at the left and right side peripheries of upper and lower plates 5 and 6 as shown in FIG. 1B. Four-plate stack preform 1 as shown in FIG. 1B is thus produced.

In the method of the first embodiment as described above, the joining operation of upper plate 5 and upper reinforcing plate 7 of reinforcement stack 4 and the joining operation of lower plate 6 and lower reinforcing plate 8 thereof can be performed by simultaneous welding. This can reduce the number of welding operations to half as compared to the method of the conventional art, serving for increase in productivity and reduction in cost.

Figure 4:
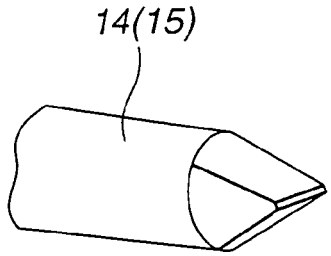
FIG. 4 is an enlarged perspective view of an electrode tip for spot welding used in the welding process as shown in FIG. 1A.
Figure 5:
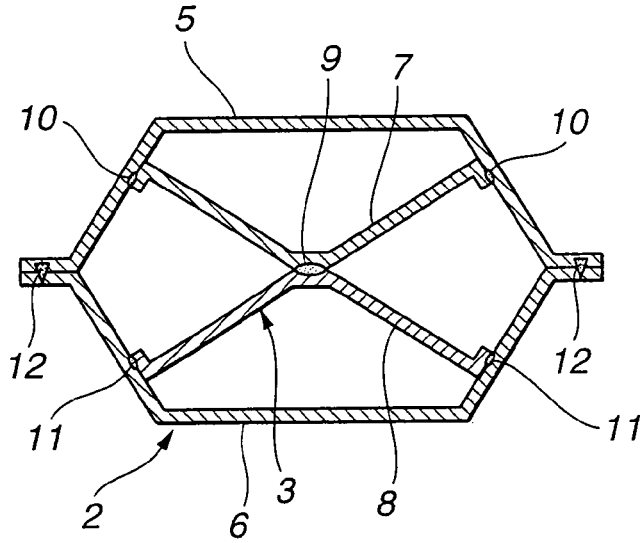
FIG. 5 is a sectional view of a vehicular frame member produced by hydrostatic forming using the preform shown in FIG. 1B.

Further, upon joining reinforcing plates 7 and 8 of reinforcement stack 4 and upper and lower plates 5 and 6 by spot welding, electrode tips 14 and 15 having the contact surface shape elongated in the weld direction, for instance, the slot shape as shown in FIG. 4, form weld junctions 10 and 11 having the elongated shape corresponding to the contact surface shape. Therefore, in spite of spot welding, stress caused in weld junctions 10 and 11 during a hydrostatic forming process can be reduced so that occurrence of break at weld junctions 10 and 11 can be suppressed.

Figure 6:
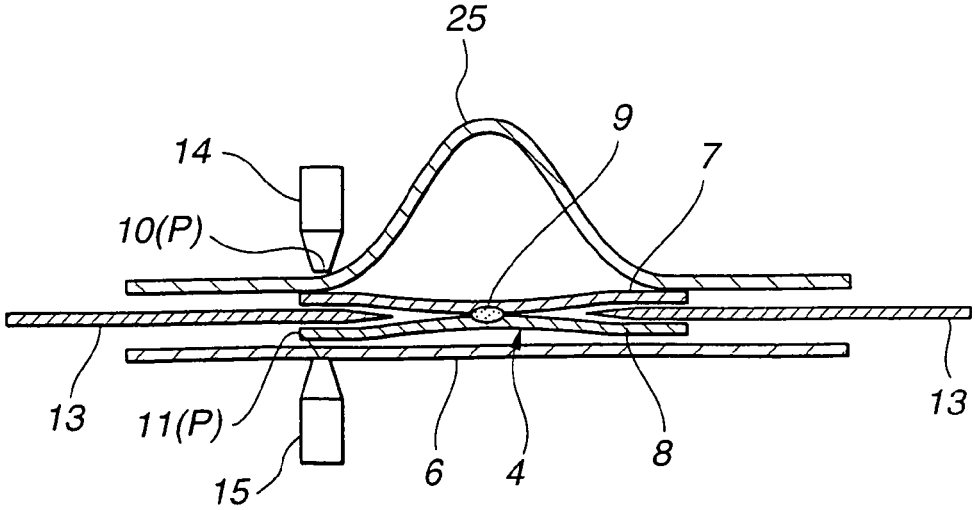
FIG. 6 is a view similar to FIG. 1A, but showing a second embodiment of the present invention.

Referring to FIG. 6, a second embodiment of the method of the present invention is explained. Like reference numerals denote like parts, and therefore, detailed explanations therefor are omitted. The second embodiment differs in the shape of upper plate 25 from upper plate 5 of the first embodiment. As illustrated in FIG. 6, upper plate 25 is previously curved upwardly and formed with a convex portion so as to have an increased size in the lateral direction. After overlapping upper plate 25 on upper reinforcing plate 7 of reinforcement stack 4 and lower plate 6 on lower reinforcing plate 8 thereof, the welding operation of upper plate 25 and upper reinforcing plate 7 and the welding operation of lower plate 6 and lower reinforcing plate 8 are simultaneously conducted using electrode tips 14 and 15. In this embodiment, when the simultaneous welding operation is conducted, upper plate 25 is welded to upper reinforcing plate 7 at a portion adjacent to the convex portion. As a result, the convex portion is located between weld junctions 10. The second embodiment has the same effects as described in the first embodiment.

Figure 7A:
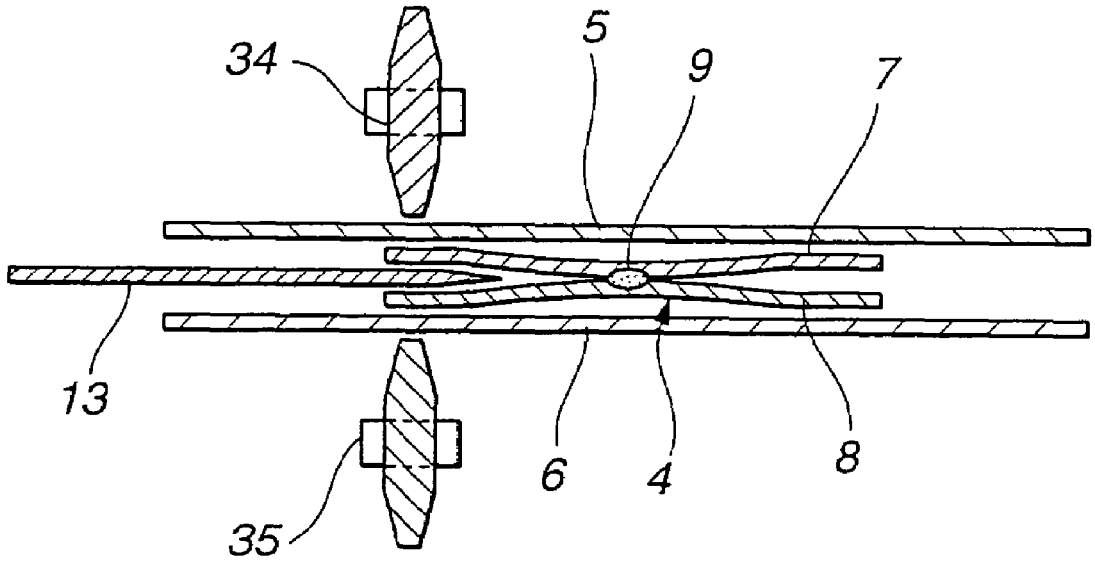
FIG. 7A is a view similar to FIG. 1A, but showing a third embodiment of the present invention.
Figure 7B:
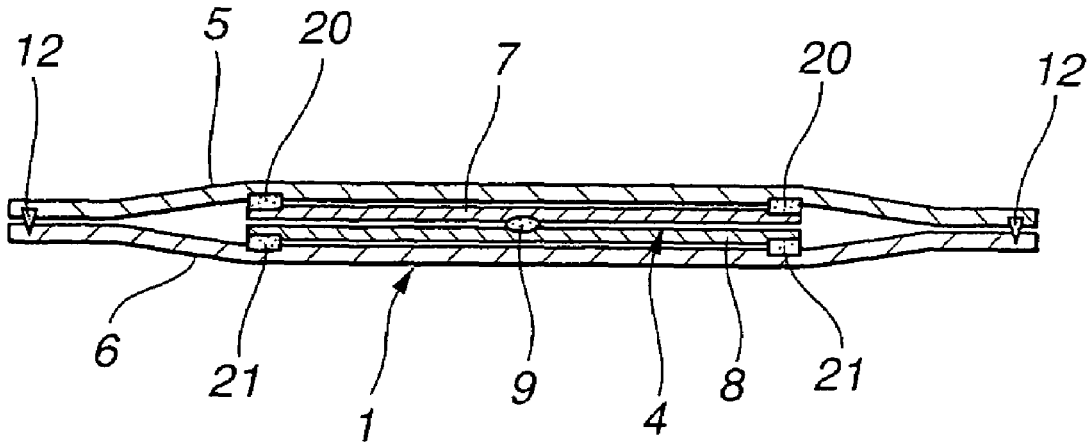
FIG. 7B is a view similar to FIG. 1B, but showing a preform produced by the method of the third embodiment of the present invention.

Referring to FIGS. 7A and 7B, a third embodiment of the method of the present invention is explained. The third embodiment differs in that electrode rollers are used, from the first embodiment using the electrode tips. As illustrated in FIG. 7A, a pair of electrode rollers 34 and 35 are used for so-called lap seam welding. Each of electrode rollers 34 and 35 has a generally disk shape. By conducting the lap seam welding with electrode rollers 34 and 35, the welding operation of upper plate 5 and upper reinforcing plate 7 of reinforcement stack 4 and the welding operation of lower plate 6 and lower reinforcing plate 8 thereof are continuously and simultaneously conducted. As illustrated in FIG. 7B, upper plate 5 and the opposite side peripheries of upper reinforcing plate 7 are joined together at weld junctions 20, and lower plate 6 and the opposite side peripheries of lower reinforcing plate 8 are joined together at weld junctions 21. The third embodiment has the same effects as described in the first embodiment.

This application is based on prior Japanese Patent Application No. 2004-264891 filed on Sep. 13, 2004. The entire contents of the Japanese Patent Application No. 2004-264891 is hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A method of producing a plate stack preform useable upon hydrostatically forming a product including a frame and a reinforcement which is disposed within the frame and has an X-shape or cross shape in section, the plate stack preform including a flat tubular body and a reinforcement stack within the tubular body, the method comprising:

preparing the reinforcement stack that has a flattened X-shape or cross shape in section and includes a first reinforcing plate and a second reinforcing plate overlapped with each other;

overlapping a first plate larger in size than the first reinforcing plate of the reinforcement stack on the first reinforcing plate thereof and a second plate larger in size than the second reinforcing plate of the reinforcement stack on the second reinforcing plate thereof;

inserting a weld-preventing conductive plate between side peripheries of the overlapped first and second reinforcing plates of the reinforcement stack, the weld-preventing conductive plate preventing the side peripheries of the overlapped first and second reinforcing plates from being welded to each other;

after the inserting operation, simultaneously conducting joining the first plate with the side periphery of the first reinforcing plate and joining the second plate with the side periphery of the second reinforcing plate by lap resistance welding; and after the simultaneously conducting joining operation, joining side peripheries of the first plate with side peripheries of the second plate by continuous welding, to form the flat tubular body within which the reinforcement stack is disposed.

2. The method as claimed in claim 1, wherein the preparing operation comprises overlapping the first reinforcing plate and the second reinforcing plate with each other, and welding the overlapped first and second reinforcing plates at a point corresponding to an intersection of the X-shape or cross shape of the reinforcement.

3. The method as claimed in claim 1, wherein the lap resistance welding is conducted using electrode tips.

4. The method as claimed in claim 3, wherein the electrode tips have a contact surface coming into contact with the first and second plates, the contact surface being formed into either one of a rectangular slot shape and an elliptic shape.

5. The method as claimed in claim 1, wherein the weld-preventing conductive plate is made of a conductive material selected from the group consisting of copper and copper alloys.

6. The method as claimed in claim 1, wherein the weld-preventing conductive plate includes a tapered side periphery formed into a knife edge-shape, the tapered side periphery being inserted between the side peripheries of the first and second reinforcing plates of the reinforcement stack.

7. The method as claimed in claim 1, wherein the weld-preventing conductive plate is formed into a generally comb shape that has cutouts and projections defined between the cutouts, the lap resistance welding being conducted at the projections.

8. The method as claimed in claim 1, wherein the lap resistance welding is spot welding.

9. The method as claimed in claim 1, wherein the continuous welding is laser welding.

10. The method as claimed in claim 1, wherein the continuous welding is seam welding.

11. The method as claimed in claim 1, wherein the first and second plates are in the form of a flat plate.

12. The method as claimed in claim 1, further comprising curving one of the first and second plates to form a convex portion, wherein the one of the first and second plates is joined with the side periphery of the corresponding one of the first and second reinforcing plates at a portion adjacent to the convex portion.

13. The method as claimed in claim 1, wherein the lap resistance welding is conducted using electrode rollers.

14. The method as claimed in claim 13, wherein the lap resistance welding is lap seam welding.

* * * * *